United States Patent [19]

Chen

[11] Patent Number: 5,069,452

[45] Date of Patent: Dec. 3, 1991

[54] RACKET HANDLE BUTT PLATE

[76] Inventor: Dennis Chen, 293 Pei Tun Road, Taichung, Taiwan

[21] Appl. No.: 574,592

[22] Filed: Aug. 29, 1990

[51] Int. Cl.[5] ..... A63B 49/00

[52] U.S. Cl. ..... 273/73 J; 273/75

[58] Field of Search ..... 273/73 R, 73 J, 75, 273/67 R, 67 DB

[56] References Cited

FOREIGN PATENT DOCUMENTS 323770 1/1930 United Kingdom ..... 273/73 J 1142073 2/1969 United Kingdom ..... 273/75

*Primary Examiner*—William H. Grieb

[57] ABSTRACT

Disclosed is a racket handle butt plate for mounting on the rear end of a racket handle, which comprises an elongated octagonal socket body made of rigid plastic injection molded material, having a single opening at one side for the insertion therein of a racket handle and being covered with a layer of resilient material of predetermined thickness by means of a secondary injection molding process, so that the butt plate has a rigid inner structure and a soft outer surface.

1 Claim, 2 Drawing Sheets

RACKET HANDLE BUTT PLATE

BACKGROUND OF THE INVENTION

The present invention is related to a structure of a racket handle and more particularly to a racket handle butt plate which has a rigid inner structure and a pliant exterior that conforms to the grip of the hand.

A racket is generally comprised of a head frame incorporated with a handle for control of the racquet with the user's hands. FIG. 1 illustrates a structure of a racket handle according to the prior art; in which a handle 1, which extends from a head frame of a racket, is covered with a tactile covering 5 formed by plastic injection molding or reactive foam molding, and is attached with a front sleeve 2 and a butt plate 3. The butt plate 3 is mounted on the rear end of the racket to protect the racket handle against damage. After the mounting of the butt plate 3, an elastic band 4 is used to bind the tactile covering 5 to the butt plate 3. The butt plate 3 is generally made from a rigid injection molded plastic. While holding a racket handle, a player usually has the palm of his hand resting against the butt plate of the racket handle so that a large striking power can be achieved. Since the butt plate is made of rigid plastic material, frequent rubbing of the palms against the butt plate may strain the tissues within the palm and cause calluses to form on the skin.

SUMMARY OF THE INVENTION

The present invention has been accomplished under the circumstances in view. It is the main object of the present invention to provide a racket handle butt plate which has a rigid inner structure and a soft outer surface that allows firm control without straining the user's hands. According to the present invention, a racket handle butt plate is for mounting on the rear end of a racket handle to protect a racket handle against damage, and at the same time esthetically complete its appearance. It comprises an elongated octagonal socket body made of a rigid plastic injection molded material having a single opening on one side for the insertion therein of a racket handle and being covered with a layer of pliant plastic of a pre-determined thickness by means of secondary injection molding process, so that the butt plate has a rigid inner structure and a soft outer surface.

DETAILED DESCRIPTION OF THE PREFERRED EMBODIMENT

Figure 1:
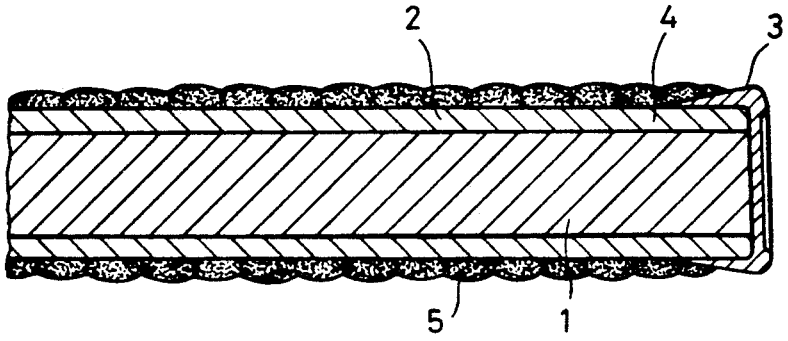
FIG. 1 is a schematic drawing of a racket handle according to the prior art.
Figure 3:
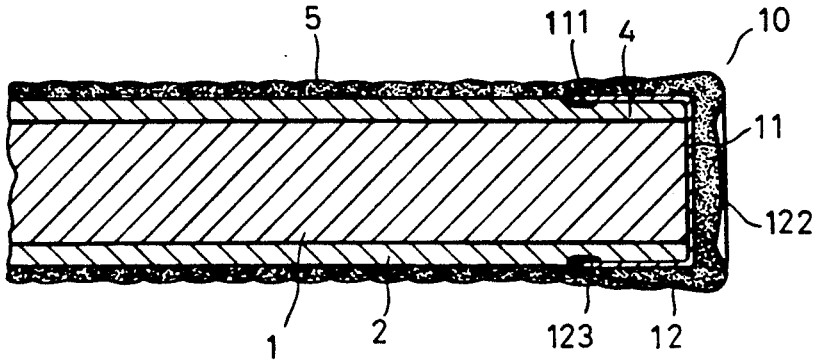
FIG. 3 is an assembly, sectional view of FIG. 2.
Figure 2:
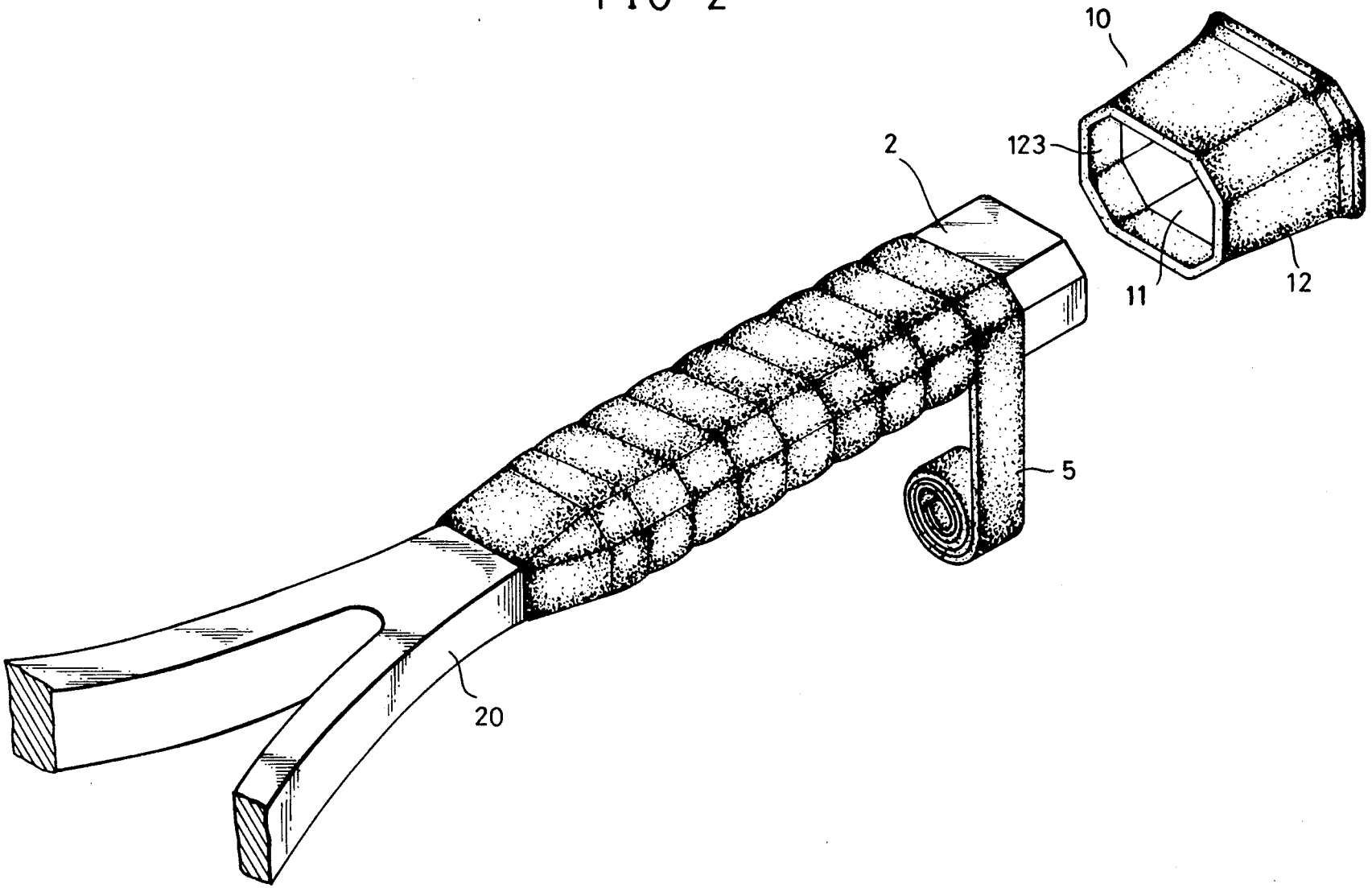
FIG. 2 is a schematic perspective view of a racket handle and a butt plate embodying the present invention.

Referring to FIGS. 2 and 3, a racket handle butt plate 10 is for mounting on the rear end of a racket handle 1 to protect it against damage and to esthetically complete its form.

The butt plate 10 comprises an elongated octagonal socket body 11 made of a rigid plastic injection molded material. The socket body has single opening at one end for the insertion therein of a racket handle and is covered with resilient material such as a layer of rubber 12 of a pre-determined thickness by means of a secondary injection molding process. The thickness 123 of the layer of rubber 12 is gradually reduced from the butt end of the butt plate 10 toward the insertion end thereof. The layer of rubber 12 forms a thick, resilient, circular, convex portion 122 at the back side of the butt plate 10 to reinforce the structure of the end cap 10 so that the end cap 10 has a rigid inner structure to support a soft outer surface which conforms to the grip of the hand. The insertion end 123 of the layer of rubber 12 slightly protrudes beyond the front edge 111 of the socket body 11 so that it can be folded over to adhere to the inner surface of the front edge 111. By means of this arrangement, the layer of rubber 12 can be firmly retained within the butt plate 10 and prevented from loosening and sliding off when it is mounted on the rear end of a racket handle.

The structure of the butt plate 10 and its manufacturing technique are simple. Though the use of a single layer of rigid plastic injected material would obviously not be suitable, the question might be raised as to whether a butt plate made entirely of injection molded rubber would simplify the manufacturing process. The disadvantage of using a pliant rubber material without a rigid backing is that such a butt plate would easily deform and loosen from the racket handle. Furthermore, a racket handle butt plate which is completely made of rubber material is too soft and forms an unstable grip. The present invention can eliminate the aforementioned problems. According to the present invention, the plastic socket body 11 of a butt plate 10 rigidly positions a butt plate 10 on a racket handle and the layer of rubber 12 provides a soft but firm grip.

I claim:

1. A racket handle butt plate for mounting on the rear end of a racket handle comprising:

an elongated octangonal socket body made of rigid plastic material;

said socket body having a single opening on one end for the insertion therein of said racket handle and being covered with a layer of resilient material with a pre-determined thickness gradually reduced from the rear end of said butt plate toward the front end thereof;

said layer of resilient material substantially protruding beyond the front edge of said socket body and being folded over to adhere the inner surface of the front edge of said socket so as to prevent said layer of resilient material from sliding off said socket body.

* * * * *